US010334964B2

(12) United States Patent
Hachmann

(10) Patent No.: US 10,334,964 B2
(45) Date of Patent: Jul. 2, 2019

(54) HOLDER ASSEMBLY

(71) Applicant: INVENTORY SYSTEMS GMBH, Berlin (DE)

(72) Inventor: Georg Hachmann, Berlin (DE)

(73) Assignee: INVENTORY SYSTEMS GMBH, Berlin (DE)

( * ) Notice: Subject to any disclaimer, the term of this patent is extended or adjusted under 35 U.S.C. 154(b) by 0 days.

(21) Appl. No.: 15/668,609

(22) Filed: Aug. 3, 2017

(65) Prior Publication Data

US 2019/0038046 A1 Feb. 7, 2019

(30) Foreign Application Priority Data

Aug. 3, 2017 (DE) ..... 10 2017 117 647

(51) Int. Cl.

| | |
|---|---|
| ***A47F 1/12*** | (2006.01) |
| ***A47F 5/00*** | (2006.01) |
| ***A47F 5/08*** | (2006.01) |
| *G08B 13/24* | (2006.01) |
| *A47F 10/02* | (2006.01) |

(52) U.S. Cl.

CPC ..... *A47F 1/121* (2013.01); *A47F 5/0006* (2013.01); *A47F 5/0823* (2013.01); *A47F 5/0869* (2013.01); *A47F 5/0876* (2013.01); *A47F 2010/025* (2013.01); *G08B 13/2402* (2013.01)

(58) Field of Classification Search

CPC ..... A47F 1/121; A47F 5/0006; A47F 5/0861; A47F 5/0823; A47F 5/0869; A47F 5/0838; G08B 13/14; G08B 13/2402; G08B 13/149; Y10T 70/5004

USPC ..... 211/59.1, 59.2

See application file for complete search history.

(56) References Cited

U.S. PATENT DOCUMENTS 1,033,915 A * 7/1912 McDonald ..... B42F 13/12 211/57.1
3,912,084 A * 10/1975 Valiulis ..... A47F 5/0823 248/220.22

(Continued)

FOREIGN PATENT DOCUMENTS

DE 2351209 A1 4/1975
FR 2581304 A1 11/1986

OTHER PUBLICATIONS

ISR in application No. PCT/EP2018/071026 dated Oct. 30, 2018.
United Kingdom Search Report dated Jan. 24, 2018 in application No. 1714696.0.

*Primary Examiner* — Patrick D Hawn
(74) *Attorney, Agent, or Firm* — Maschoff Brennan

(57) ABSTRACT

A holder assembly for hanging goods to be displayed at a point of sale includes at least one elongated holding member at which goods are to be hanged and to be arranged in a row of goods one behind the other so that the hanging goods may be slid along the at least one elongated member to a removal position at an end of the at least one elongated member where a good may be removed from the at least one elongated holding member. The assembly further includes a carrier to which the at least one elongated holding member is mounted and at which an electronic detection element is provided. An electronic detection element of the holder assembly is configured to detect a displacement of the at least one elongated holding member from a first position to a second position for emitting at least one signal.

20 Claims, 18 Drawing Sheets

(56) References Cited

U.S. PATENT DOCUMENTS 4,394,909 A * 7/1983 Valiulis ..... A47F 5/0823 211/59.1
4,474,300 A * 10/1984 Entis ..... A47F 5/0861 211/4
4,540,093 A * 9/1985 Merl ..... A47F 5/0869 211/59.1
4,823,964 A * 4/1989 Lundberg ..... A47F 5/0869 211/57.1
5,123,189 A * 6/1992 Fast ..... A47F 5/0869 211/59.1
5,199,140 A * 4/1993 Valiulis ..... A47F 5/0869 24/542
5,375,725 A * 12/1994 Rosenthal ..... A47F 5/0869 211/59.1
5,485,930 A * 1/1996 Rushing ..... A47F 5/0861 211/59.1
5,499,723 A * 3/1996 Morrow ..... A47F 5/0823 211/59.1
5,711,432 A * 1/1998 Stein ..... A47F 5/0861 211/57.1
5,718,340 A * 2/1998 Nagel ..... A47F 5/0869 211/57.1
5,984,118 A * 11/1999 Morrow ..... A47F 5/0823 211/59.1
6,389,722 B1 * 5/2002 Josefsson ..... A47F 5/0869 211/57.1
6,474,478 B1 * 11/2002 Huehner ..... A47F 5/0861 211/4
7,197,902 B1 * 4/2007 Barkdoll ..... A47F 5/0861 211/57.1
7,278,617 B2 * 10/2007 Valiulis ..... A47F 1/128 211/59.1
7,392,673 B2 * 7/2008 Fawcett ..... A47F 5/0861 211/7
7,484,628 B2 * 2/2009 Schneider ..... A47F 5/0861 211/47
7,530,188 B2 * 5/2009 Beilenhoff ..... A47F 5/0869 211/57.1
7,703,308 B2 * 4/2010 Nagelski ..... A47F 5/0861 211/54.1
7,768,399 B2 8/2010 Hachmann et al.
7,810,774 B2 * 10/2010 Miyaue ..... A47F 5/0838 211/57.1
7,909,183 B2 * 3/2011 Oh ..... A47F 11/10 211/59.1
8,485,391 B2 * 7/2013 Vlastakis ..... A47F 1/126 211/184
8,499,941 B2 * 8/2013 Barkdoll ..... A47F 5/0823 211/59.1
8,534,469 B2 * 9/2013 Northrup, Jr. ..... A47F 5/0861 211/57.1
8,629,772 B2 * 1/2014 Valiulis ..... G08B 13/149 211/57.1
8,739,981 B2 * 6/2014 Piskor ..... A47F 5/0861 211/59.1
9,318,007 B2 * 4/2016 Valiulis ..... G08B 13/14
9,318,008 B2 * 4/2016 Valiulis ..... A47F 5/0823
9,386,864 B2 * 7/2016 Pongrac ..... A47F 5/0861
9,468,315 B2 * 10/2016 Ha ..... A47F 5/0861
9,820,587 B1 * 11/2017 Cheng ..... E05B 73/00
2004/0182975 A1 * 9/2004 Valiulis ..... A47F 1/128 248/220.31
2005/0081418 A1 * 4/2005 Fast ..... A47F 5/0869 40/661
2006/0266899 A1 * 11/2006 Schneider ..... A47F 5/0861 248/220.21
2007/0102379 A1 * 5/2007 Strand ..... A47F 5/0823 211/59.1
2007/0241069 A1 * 10/2007 Nagelski ..... A47F 5/0823 211/57.1
2008/0309489 A1 * 12/2008 Hachmann ..... A47F 5/0861 340/568.8
2009/0095695 A1 * 4/2009 Moock ..... A47F 5/0861 211/57.1
2013/0141240 A1 6/2013 Valiulis et al.
2013/0248469 A1 * 9/2013 Piskor ..... A47F 5/0861 211/59.2
2014/0070948 A1 * 3/2014 Valiulis ..... G08B 13/149 340/568.8
2014/0197953 A1 * 7/2014 Valiulis ..... G08B 13/149 340/568.8
2014/0352372 A1 * 12/2014 Grant ..... A47F 5/0861 70/57.1
2015/0216325 A1 8/2015 Pongrac et al.
2017/0188723 A1 7/2017 Will
2017/0265654 A1 * 9/2017 Hachmann ..... A47F 5/0861

* cited by examiner

HOLDER ASSEMBLY

FIELD

The present invention relates to a holder assembly for goods to be displayed at a point of sale.

BACKGROUND

Holder assemblies for hanging goods to be displayed at a point of sale are well-known. Typically, such a holder assembly comprises at least one elongated holding member, for example in the form of a wire or hook, at which goods, like blister packs, are to be hanged and to be arranged in a row of goods one behind the other. The hanging goods may be slid along the at least one elongated holding member to a removal position at an end of the at least one elongated holding member where goods may be removed from the at least one elongated holding member. Usually, rather expensive goods like a razor blades or cosmetic products are displayed at a point of sale by means of a holder assembly. Those products shall be easily removable from the holder assembly by a potential buyer. Furthermore, refilling the holder assembly with new goods shall also be rather simple.

However, in practice holder assemblies with at least one elongated holding member are extremely prone to shoplifters since a great amount of expensive goods may be easily removed from the holder assembly at the same time. In applicant's U.S. Pat. No. 7,768,399 holder assembly is thus proposed which automatically determines a removal frequency at which goods are removed from a holding member. In case the determined removal frequency exceeds a threshold value an alarm signal is automatically emitted in order to indicate that an atypical removal of goods has occurred, i.e., a removal of many goods over a rather short period of time, which usually is a sign of a shoplifter grabbing several goods from the holder assembly. It is thus typical for an illicit removal that a large number of goods are taken from the holder assembly over a short period of time.

In the solutions proposed in the prior art detection electronics for determining a removal frequency typically measure a displacement of a barrier element which is arranged at the at least one elongated holding member for the goods in such a way that a good to be removed has to pass the respective barrier element and to thereby displace it. An example of such a barrier element in U.S. Pat. No. 7,768,399 is a swinging arm which may be displaced from a blocking position to a removal position for allowing one good at a time to be removed from a hook-shaped or rod-like elongated holding member.

A holder assembly with a barrier element at an elongated holding member at which the goods are to be hanged may not be preferred under certain circumstances although such a holder assembly provides for an effective protection against shoplifters. For example, certain shops prefer and certain packages require holder assemblies with a single wire as an elongated holding member at which goods are to be hanged. Furthermore, in certain countries goods to be hanged at a holder assembly, like blister packs, just comprise a single circular hole for hanging the respective good to a single wire. To combine such single wire with a movable barrier element in order to detect a removal frequency can be a rather complex thus resulting in higher costs for the holder assembly. Further, the consumer's acceptance of a holder assembly decreases in the case a removal of goods is experienced to be too complicated. A complex mechanical structure with a barrier element whose displacement is measured in order to determine a removal frequency of goods can also make a refilling of goods more difficult.

SUMMARY

A holder assembly for hanging goods to be displayed at a point of sale is proposed which comprises (a) at least one elongated holding member at which goods are to be hanged and to be arranged in a row of goods one behind the other so that the hanging goods may be slid along the at least one elongated holding member to a removal position at an end of the at least one elongated holding member where a good may be removed from the at least one elongated holding member as well as (b) a carrier to which the at least one elongated holding member is mounted and at which an electronic detection element is provided. In a proposed holder assembly the at least one elongated holding member is displaceable between a first position and a second position, wherein the at least one elongated holding member is configured to be displaced from the first position to the second position in order to allow for a removal of at least one foremost good of a row of hanging goods arranged at the at least one elongated holding member. The electronic detection element is configured to detect a displacement of the at least one elongated holding member to the second position for emitting at least one signal. In the present solution the elongated holding member itself is thus displaceable in order to allow for a removal of at least one good from the at least one holding member. The corresponding displacement of the at least one elongated holding member may be electronically detected by one or more electronic detection elements at the carrier of the holder assembly. Based on a detected displacement of the at least one elongated holding member at least one signal is emitted, such at least one signal for example being indicative for a (potential) removal of at least one good from the at least one elongated holding member. The at least one signal may inform about a removal of a good, like a removal of a blister pack, from the at least one elongated holding member visually and/or acoustically In one embodiment the at least one elongated holding member is configured to be (a) displaced, in particular to be pushed or pulled, perpendicular to a direction along which goods are slidable at the at least one elongated holding member or (b) swilled about a swivel axis running perpendicular to the direction along which goods are slidable at the at least one elongated holding member. Thereby, the at least one elongated member may (a) be displaced linearly along a displacement axis running perpendicular to the direction along which goods are slidable at the at least one elongated holding member or (b) be swivelled about a swivel axis near or at the carrier which swivel axis runs transversely to the direction along which goods are slidable at the at least one elongated holding member. The goods are thus slidable along a direction of extent of the at least one elongated holding member for a removal of a good from the at least one elongated holding member. The at least one elongated holding member may thus for example be displaceable from the first position downwards to the second position. In this embodiment, the at least one elongated holding member at which goods are to be hanged as a whole may for example be pushed downwards (and relative to the carrier of the holder assembly) or a free end of the at least one elongated holding member may be swivelled downwards in order to determine a potential removal of goods and to impede unnoticed removals of goods from the at least one elongated holding member of the holder assembly.

In one embodiment the at least one elongated holding member is configured to be manually pressed or pulled from the first position to the second position by a user before at least one good may be removed from the at least one elongated holding member. In such an embodiment a user may actively press or pull the at least one elongated holding member at which the goods are hanging to a second position in order to make a removal of a good from the at least one elongated holding member possible. For example, a barrier element is provided at the holder assembly relative to which the at least one elongated holding member may be displaced into its second position thereby moving the at least one elongated holding member to a position relative to the barrier element in which a good may be slid past the barrier element. In contrast thereto getting past the barrier element is not possible for a good in the first position of the at least one elongated holding member. In the first position of the at least one elongated holding member the barrier element blocks a removal of a good.

In one embodiment the at least one elongated holding member is configured to be displaced from the first position to the second position upon sliding at least one good to the end of the at least one elongated holding member. In this regard the holder assembly is provided with a structure that automatically displaces the at least one elongated holding member from its first position to its second position when at least one good is slid to the end of the at least one elongated holding member for removal. In such an embodiment the user may still manually press or pull the at least one elongated holding member actively from the first position to the second position before exerting a force to a good for sliding it along the at least one elongated holding member. This is, however, not mandatory. The user may just slide the at least one good to be removed along the at least one elongated holding member wherein the sliding to the end of the at least one elongated holding member automatically results in a displacement of the at least one elongated holding member from its first position to its second position. In this context the holder assembly may for example comprise a displacing element which partially converts a force, which is exerted on a good hanging at the at least one elongated holding member in order to at least slide this good towards the end of the at least one elongated holding member, to a displacing force acting on the at least one elongated holding member for displacing, for example pushing, the at least one elongated holding member to its second position. The at least one elongated holding member may thus be displaceable with to the displacing element.

Generally, the displacing element can be mounted at holder part of the holder assembly which is spaced apart from the at least one elongated holding member and past which a good is to be moved when the good is slid towards the end of the at least one elongated holding member. The holder part may for example comprise a top wire running in parallel to a section of the at least one elongated holding member.

In one embodiment the displacing element comprises a tag configured to display information, like a price, on the goods to be arranged at the at least one elongated holding member.

In one embodiment the displacing element is configured for pushing the at least one elongated holding member from the first position to the second position. Such a displacing element is not necessarily movable. In one embodiment an immovable displacing element is proposed which comprises an inclined contact surface. Along this inclined contact surface a good hanging on the at least one elongated holding member and moved towards the end of the at least one elongated holding member for removal has to slide thereby pushing the at least one elongated holding member to its second position in order to get the good past the displacing element. By its inclined contact surface the displacing element is also configured for pushing the at least one elongated holding member from the first position to the second position upon sliding at least one good to the end of the least one elongated holding member.

In an alternative embodiment the displacing element configured for pushing the at least one elongated holding member from the first position to the second position is movably mounted at the holder assembly. in this embodiment the displacing element is configured to be displaced in order to partially convert a force exerted on the good(s) to be removed into a displacing force for displacing the at least one elongated holding member to its second position. For example, the displacing element is mounted pivotably at a holder part of the holder assembly, which holder part is spaced apart from the at least one elongated holding member and past which holder part a good is to be moved when the good is slid to the end of the at least one elongated holding member. Such a displacing element is thus configured to be pivoted upon sliding a good to be removed from the at least one elongated holding member to the end of the at least one elongated holding member in order to enable the removal of the good. The displacing element thereby exerts a displacing force to the at least one elongated holding member due to which the at least one elongated holding member is displaced to its second position which displacement is detected using the electronic detection element.

In one embodiment a displacing element being pivotably mounted at a holder part comprises are lobe portion extending towards the at least one elongated holding member and extending into an adjustment path along which a good is to be moved towards the end of the at least one elongated holding member. A good hanging at the least one elongated holding member and moved towards the end of the at least one elongated holding member has to contact the lobe portion and thus pivot the displacing element before the good can be removed from the at least one elongated holding member. The good acting on the lobe portion applies a force to the lobe portion due to which the displacing element is pivoted. Upon this pivotal movement of the displacing element the lobe portion acts on the at least one elongated holding member pushing it from the first position to the second position. The lobe portion may be rigidly connected to or integrated with a bearing or hinge portion of the displacing element the displacing element being pivotably mounted via its bearing or hinge portion.

The lobe portion may be displaceable upon pivoting of the displacing element from (1) a blocking position, in which the lobe portion reaches into the adjustment path of a good to be moved towards the end of the at least one elongated holding member, via (2) a pushing position, in which the lobe portion pushes the at least one elongated holding member to the second position by increasing a distance of the at least one elongated holding member to the holding part at which the displacing element is pivotably mounted, to (3) are removal position, in which the good may be removed from the at least one elongated holding member and the lobe portion no longer pushes the at least one elongated holding member to the second position. The holder assembly in this embodiment thus comprises a displacing element with a lobe portion which is configured to be moved from our blocking position via a pushing position into a removal position upon sliding a good which is to be removed from the at least one elongated holding member along the at least one elongated holding member. The good thereby necessarily contacts the lobe portion in its blocking position. Continuing sliding the good then results in pivoting the displacing element and thereby forcing the lobe portion to the pushing position in which the lobe portion acts on the at least one elongated holding member pushing it to its second position. Upon further sliding the good to the end of the at least one elongated holding member the lobe portion reaches the removal position in which the lobe portion no longer pushes the at least one elongated holding member to its second position and does not block a removal of the good from the at least one elongated holding member.

As already outlined above, the displacing element may be immovable, in particular rigidly fixed to the carrier of the holder assembly and may comprise an inclined contact surface. In one embodiment such a displacing element may include a wedge-shaped (displacing) body.

In one embodiment the at least one elongated holding member is biased towards the first position by at least one spring element if no external force is applied to a good hanging at the at least one elongated holding member and/or directly to the at least one elongated holding member. The at least one elongated holding member is automatically positioned in its first position by the at least one spring element. The at least one spring element may be supported at the carrier. Such a spring element may be accommodated in housing of the carrier. In one embodiment the at least one spring element comprises a pressure spring.

At least one stopper element can be provided at the carrier which blocks a movement of the at least one holding member beyond the first position due to a spring force exerted by the at least one spring element. In this regard a portion of the at least one elongated holding member or a part connected to the at least one elongated holding member may be pushed or pulled against the at least one stopper element by the at least one spring element so that the stopper element stops a spring-driven movement of the at least one elongated holding member from the second position at the first position.

In one embodiment the at least one elongated holding member is fixed to a trigger element at the carrier, the trigger element being displaceable relative to the (at least one) electronic detection element of the holder assembly. A displacement of the at least one elongated holding member thus results in a corresponding displacement of the trigger element like a displacement of the trigger element results in a corresponding movement of the at least one elongated holding member fixed to it.

The electronic detection element in one embodiment comprises at least one of a micro-switch and a reed switch (or reed relay). The holder assembly may be configured to actuate the micro-switch or reed switch upon a displacement of the at least one elongated holding member from its first position to its second position. In the second position a trigger element fixed to the at least one elongated holding member may act on the micro-switch thereby allowing for an electronic detection of the displacement of the at least one elongated holding member to its second position. In another embodiment a magnet provides a magnet field which opens or closes contacts of the reed switch depending on the position of the at least one elongated holding member. For example, the holder assembly can be configured such that the contacts of the reed switch are normally closed and thus open when the at least one elongated holding member is in its first position and a magnetic field is present. When the at least one elongated holding member is displaced to its second position a distance of the magnet to the reed switch increases and the contacts return their normal closed position thereby generating an electric signal. This electric signal is thus indicative for the displacement of the at least one elongated holding member to its second position.

The holding assembly in one embodiment comprises electronics for determining at least one of a removal frequency at which goods are removed from the at least one elongated holding member and a time the at least one elongated holding member is in the second position. The emission of the at least one signal (which could be indicative of a (potential) removal of at least one good from the at least one elongated holding member) may depend on at least one of the removal frequency and the time exceeding a corresponding threshold value. If it is for example detected that the at least one elongated holding member is displaced several times to the second position within a rather short period of time (e.g., more than 3 times in 5 seconds or more than 7 times in 30 seconds) or if it is detected that the at least one elongated holding member remains in the second position for more than 3, 5 or 10 seconds, a signal may be generated and emitted by the holding assembly indicating are potentially illicit removal of goods by a shoplifter. In a further embodiment, signals are emitted successively after pre-defined time periods in case the at least one elongated holding member is in the second position longer than a threshold value and is kept in the second position. In one embodiment at least two different types of signals are emitted depending on the time the at least one elongated holding member is in the second position. For example, the holder assembly may be configured to emit a first signal every 2 or 3 seconds after the at least one elongated holder assembly has remained in the second position for more than a first threshold value of 2 seconds (the first signal being emitted after those 2 seconds). After a number of first signals have been emitted, e.g., after 2 or 3 first signals, and the at least one elongated member thus has stayed in the second position for an additional time period thereby exceeding a second threshold value, for example of 6 seconds, a second signal is emitted. Whereas the first signals can be faint beeps, the second signal can be an alarm signal. Such an alarm signal can comprise an acoustic signal being significantly louder than the first signals. The second signal can also comprise a visual alarm and/or a wireless signal transmitted to a receiver for informing a remote user of a potential shoplifter.

The holding assembly may comprise electronics for emitting at least one of an acoustic signal and an optical signal for indicating are removal of at least one good from the at least one elongated holding member based on the displacement of the at least one elongated holding member to the second position. In this context an acoustic signal and/or an optical signal may be emitted every time the at least one elongated holding member is displaced to the second position. In case of an acoustic signal a frequency of removal may be determined by an acoustic receiver determining the removal frequency on the basis of emitted acoustic signals of the receive. In addition or in the alternative, an acoustic signal and/or an optical signal may be emitted as an alarm signal for indicating a potentially illicit removal. The alarm signal may be generated when the electronics determine that a removal frequency or time the at least one elongated holding member is in the second position exceeds a given threshold value.

In one embodiment the holder assembly comprises at least two elongated holding members. The holder assembly comprising two or more elongated holding members may include a single carrier to which the elongated holding members are mounted each of the elongated holding members being displaceable between a first position and a second position. A displacement of each elongated holding member or of groups of with one or more may be detected individually so that one or more electronic detection elements may indicate which one of the elongated holding members of the holder assembly or which group was displaced. In an alternative embodiment a single electronic detection element is provided at the carrier which single electronic detection element is configured to detect a displacement of at least one of the elongated holding members. Thereby, the electronic detection element is triggered if any one of the delegated holding members of the holder assembly is displaced.

The holder assembly may constitute a module with one or more of the elongated holding members and integrated electronics for electronically detecting a removal of goods from one or more of the elongated holding members. A carrier of such a module may comprise a fastening structure for fastening the whole module with one or more elongated holding members to a point of sale display arrangement, for example for fastening the module to our display rack.

In one embodiment of a holder assembly comprising at least two elongated holding members the holder assembly may comprise one trigger element at the carrier to which at least two elongated holding members are fixed. The trigger element being displaceable relative to an electronic detection element may thus act on the electronic detection element via the trigger element fixed to the at least one elongated holding member. The trigger element may comprise a trigger beam to which at least two elongated holding members are fixed. The elongated holding members may be equally spaced at such a trigger beam, in particular at defined fixing locations at the trigger beam. Such fixing locations may be defined by receptacles, for example in the form of fixing slots, into which a portion of an elongated holding member is blocked

BRIEF DESCRIPTION OF THE DRAWINGS

The previously mentioned and other advantages of the present solution will be apparent to those skilled in the art upon consideration of the following specification and the attached drawings.

DETAILED DESCRIPTION

Figure 1A:
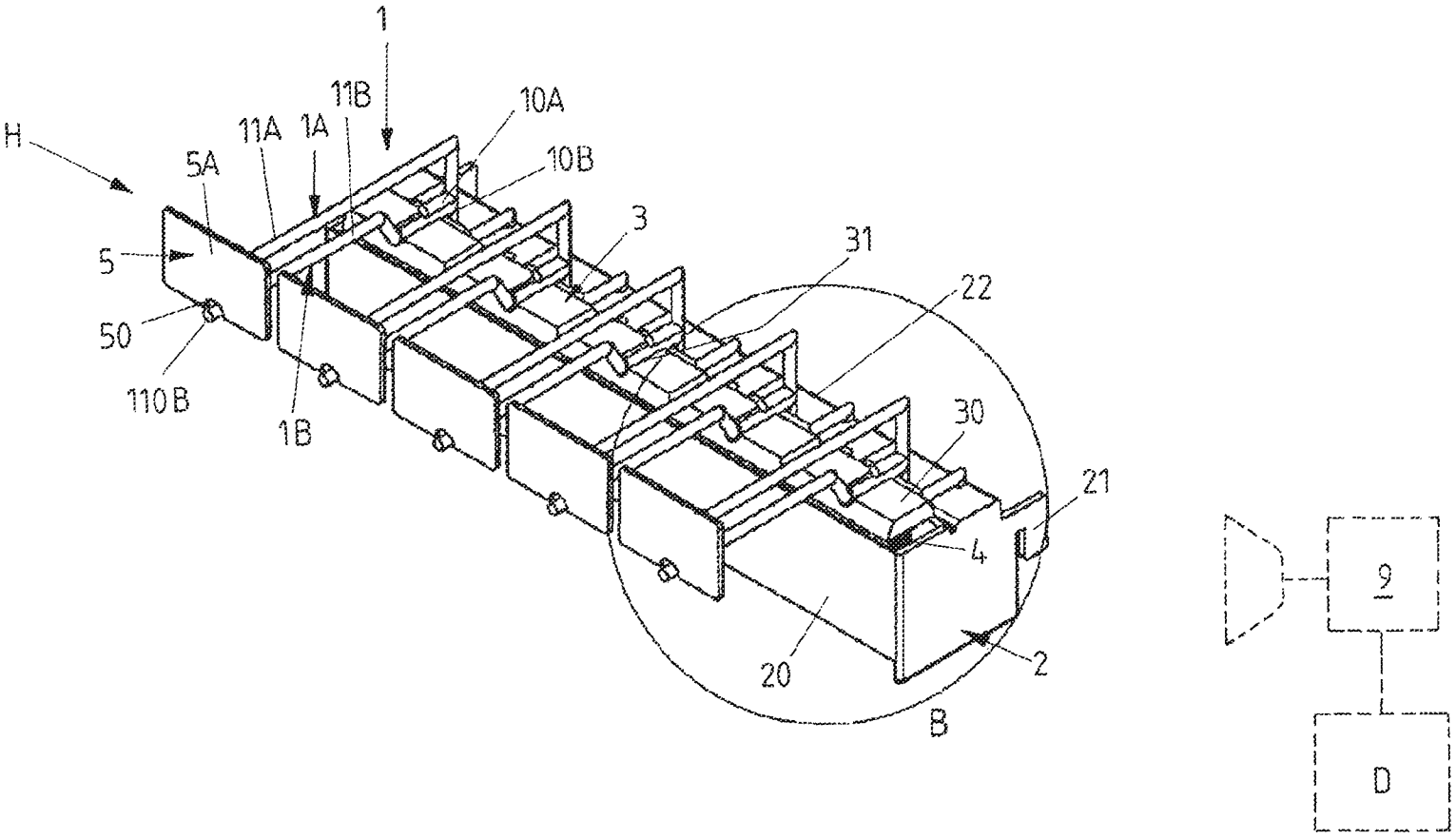
FIGS. 1A to 3 show a 1st embodiment of a holder assembly in different views, which holder assembly comprises several elongated holding members for hanging goods each of the elongated holding members being displaceable between a first position and a second position in order to electronically detect a removal of a good from one of the elongated holding members.
Figure 1B:
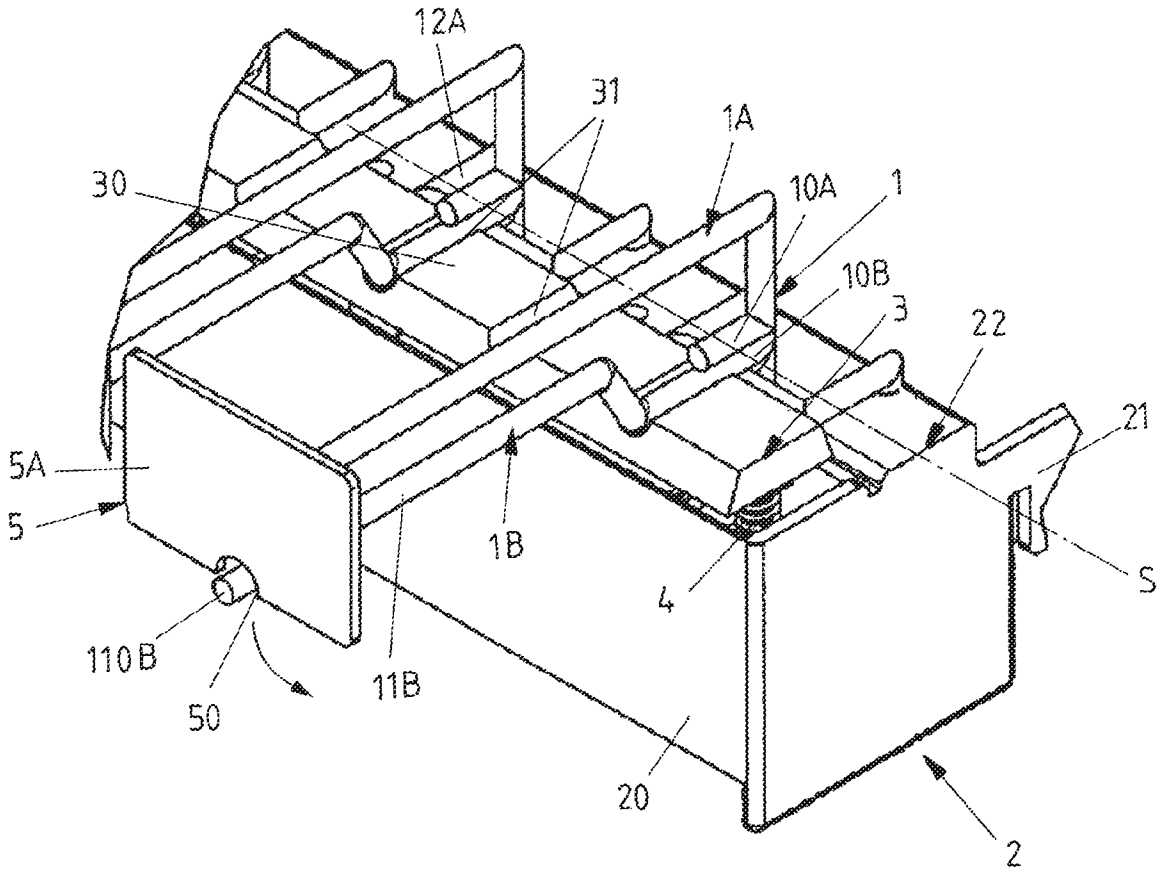
Figure 1C:
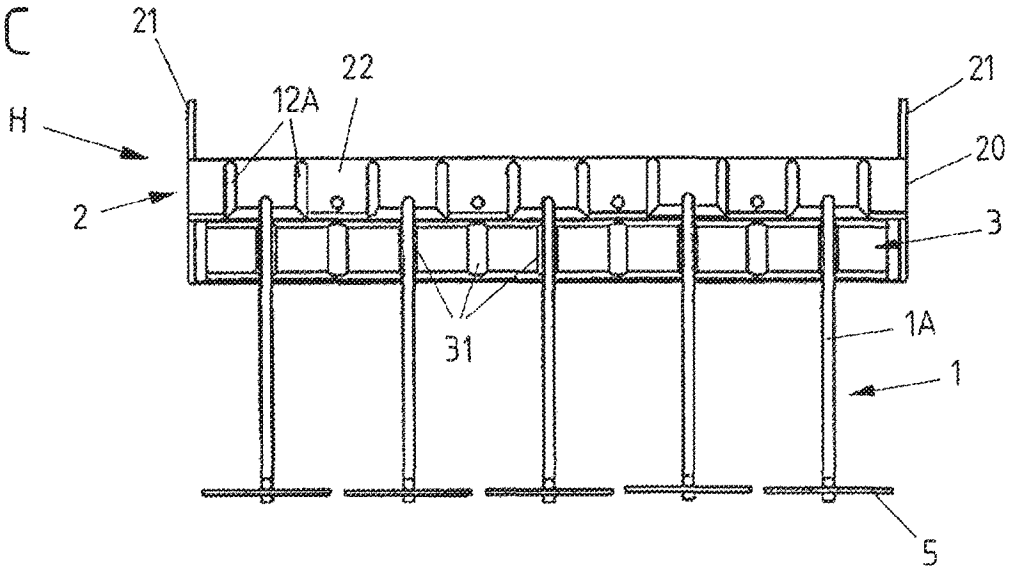
Figure 2:
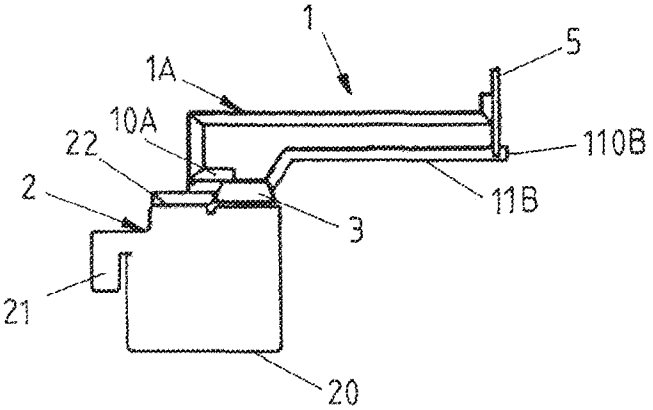

FIGS. 1A to 3 show a first embodiment of a holder assembly H comprising a carrier 2 with a carrier housing 20 at which several holder devices 1 are mounted. Each holder device 1 comprises one elongated holding member in the form of a bottom wire 1B at which goods to be displayed at the point of sale may be hanged and arranged in a row one behind the other. Goods hanging at the bottom wire 1B may be slid along the bottom wire 1B to a removal position at a free end 110B of the bottom wire 1B where goods may be removed from the bottom wire 1B. Above the bottom wire 1B a holder part in the form of a top wire 1A is provided. The top wire 1A is spaced apart from the bottom wire 1B and carries a tag 5 at its end projecting from the carrier 2. The tag 5 comprises a front face 5A at which information on the goods to be hanged on the bottom wire 1B may be displayed. A bottom margin of the tag 5 comprises a wire opening 50 through which the free end 110B of the bottom wire 1B extends.

The top wire 1A of each holder device 1 is fixedly connected via fastening portions 12A to the carrier housing 20. The fastening portions 12A are provided at an end of the top wire 1A distant from the tag 5 and are formed by two parallel wire base portions. The fastening portions 12A are fixed to a carrier beam 22 of the carrier housing 20. The holder devices 1 are fixed at the carrier beam 22 in such a way that the holder devises 1 are equally spaced and their top and bottom wires 1A, 1B run in parallel to each other. The carrier housing 20 furthermore integrates at least two hook-shaped fastening elements 21 for fastening the holder assembly H to a point-of-sale display arrangement. Via the fastening elements 21 the carrier 2 and thus the complete holder module provided by the holder assembly H may be hanged to such a display arrangement.

Whereas a top wire 1A of each holder device 1 is rigidly fixed to the carrier 2, each bottom wire 1B is mounted displaceable with respect to the top wire 1A. Each bottom wire 1B may thus be displaced from a first position shown in FIGS. 1A to 3 downwards to a second position in which a distance between the top wire 1A and the bottom wire 1B is increased. The displaceable bottom wire 1B is fixed to a trigger element in the form of an elongated trigger bar 3. The trigger bar 3 is arranged perpendicular to the holder devices 1 and in parallel to the carrier beam 22. Along its direction of extent the trigger bar 3 comprises several equally spaced slot-like connecting receptacles 31 for mounting wire end sections 10B of the bottom wires 1B to the trigger bar 3. A wire end section 10B of each bottom wire 1B is angled away from a straight wire section 11B of the respective bottom wire 1B at which the goods are to be arranged. Each wire end section 10B is plugged into a connecting receptacle 31 at a top surface 30 of the trigger bar 3. In the configuration shown in FIGS. 1A to 3 the trigger bar 3 comprises more connecting receptacles 31 then the holder devices 1 are mounted to the carrier 2. Namely, just every second connecting receptacle 31 at the trigger bar 3 is occupied. The different connecting receptacles 31 of the trigger bar 3 allow for arranging different numbers of holder devices 1 at the carrier 2 and allow for assembling a holder assembly H in different configurations. For example, a holder assembly with less (e.g., three) holder devices 1 compared to the holder assembly H of FIGS. 1A to 3 may be provided with the same trigger bar 3.

The trigger bar 3 is arranged in parallel to the carrier beam 22 to which the top wires 1A of the different holder devices 1 are fixed. By several spring elements in the form of pressure springs 4 the trigger bar 3 is biased (upwards) towards a straight wire section 11A of the top wire 1A at whose end the tag 5 is arranged. To restrict a displacement of the trigger bar 3 and thus of the bottom wire 1B fixed to it a stopper element 10A is a provided at each holder device 1. These stopper elements 10A block the trigger bar 3 from an upward movement beyond the position shown in FIGS. 1A to 3 in which the bottom wire 1B of each holder device 1 is located in its first position at a predefined distance to the associated top wire 1A.

In order to remove a good from the bottom wire 1B of a holder device 1, namely from the wire section 11B of the bottom wire 1B, the bottom wire 1B has to be pushed or pulled downwards so that goods can be moved past the tag 5 at the free end 110B of the bottom wire 1B. For this displacement of the bottom wire 1B a consumer/user may pull a good hanging at the bottom wire 1B downwards or the consumer/user may exert a pushing force to the top surface 30 of the trigger bar 3. In either way the trigger bar 3 with the bottom wire 1B is to be displaced into a second position in order to allow for a removal of a good from the bottom wire 1B.

Due to the pressure springs 4 acting on the trigger bar 3 a bottom wire 1B of a holder 1 is automatically pushed back to its first position once the good is removed and a manual force is no longer applied to the bottom wire 1B or the trigger bar 3 by a user/consumer pushing or pulling the bottom wire 1B and/or the trigger bar 3 downwards (via a good hanging at the bottom wire 1B and/or applying a force directly to the bottom wire 1B and/or the trigger bar 3).

Figure 3:
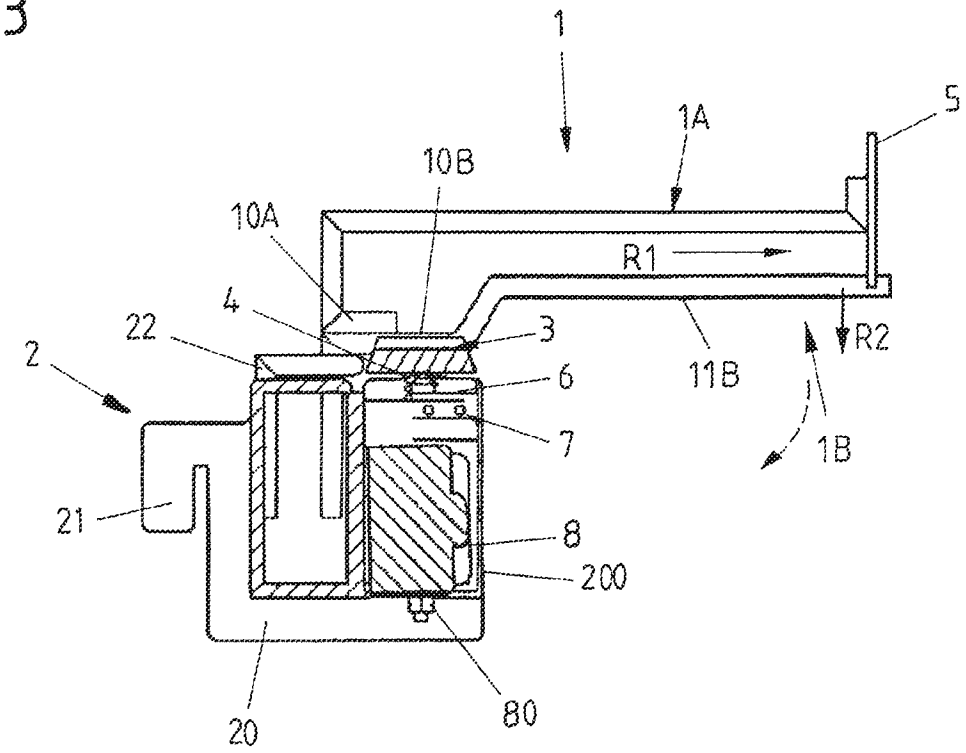
Figure 4A:
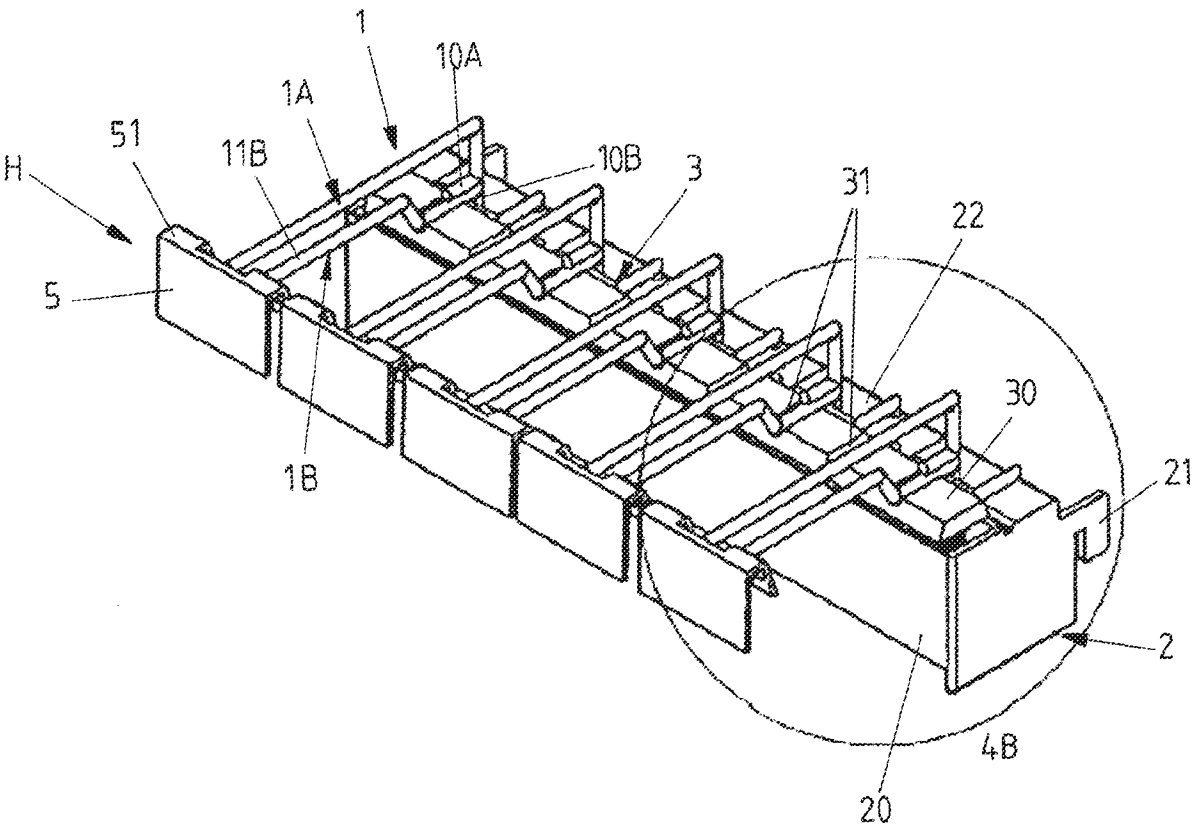
FIGS. 4A to 8B show a second embodiment of a holder assembly in which each elongated holding member is associated with a pivotable displacing element comprising a displacing lobe for automatically displacing an elongated holding member.
Figure 4B:
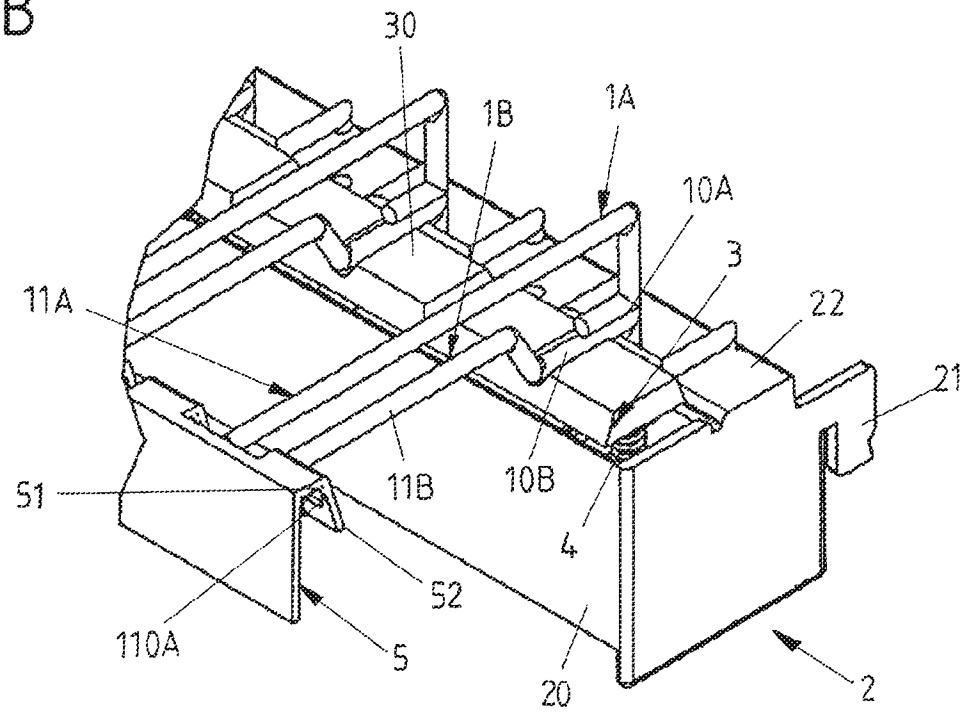
Figure 4C:
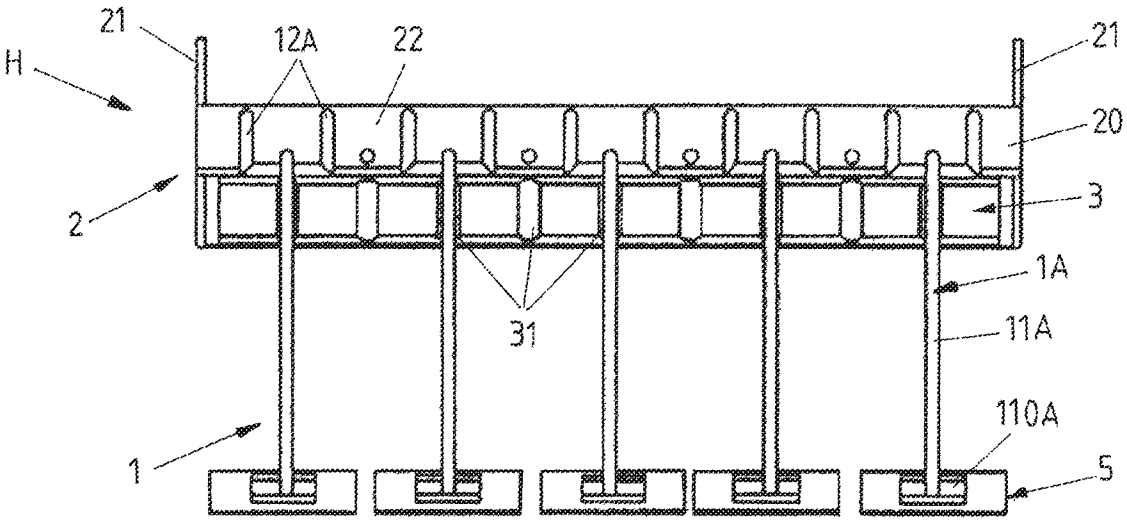
Figure 5:
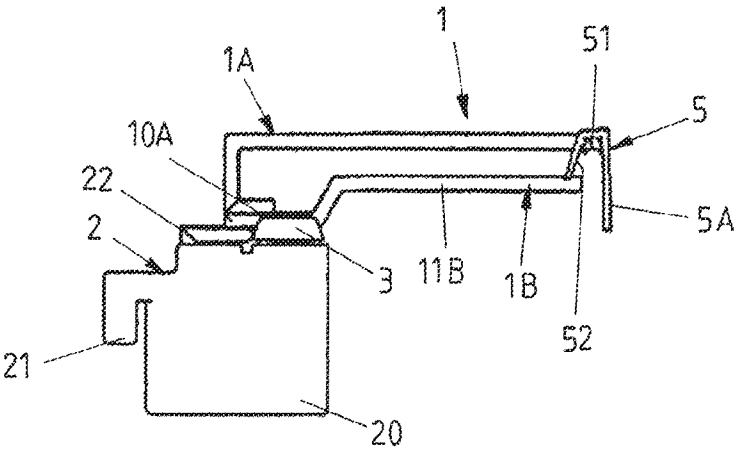
Figure 6:
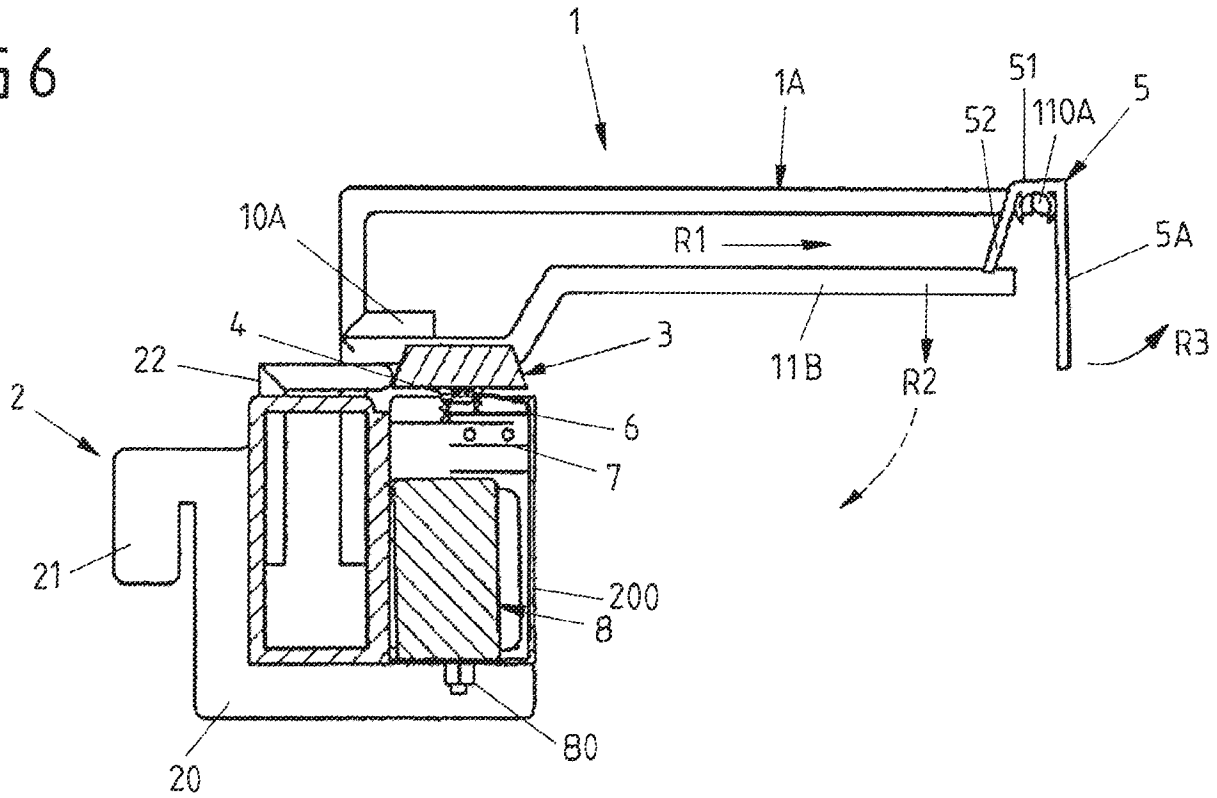
Figure 7:
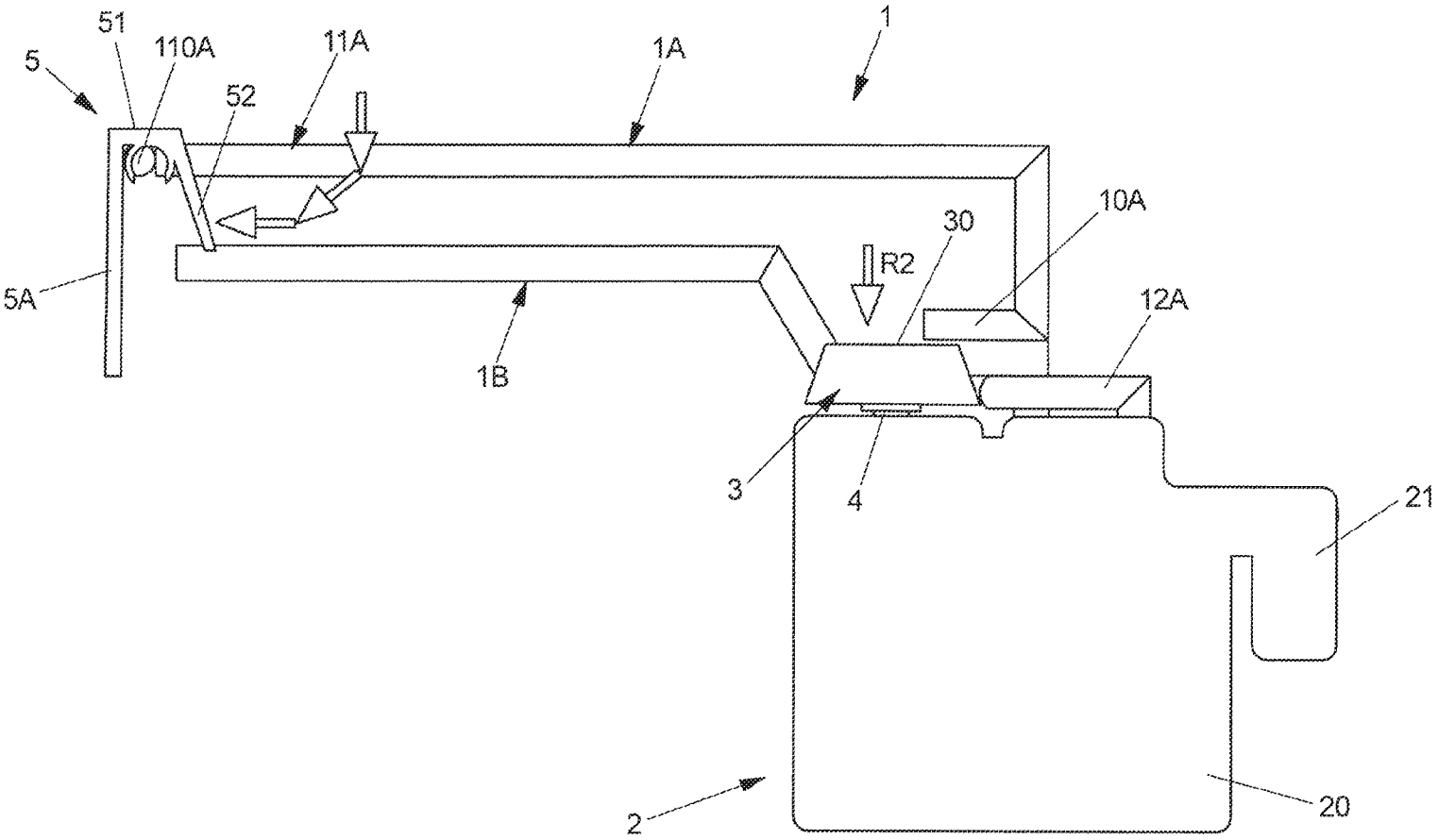
Figure 8A:
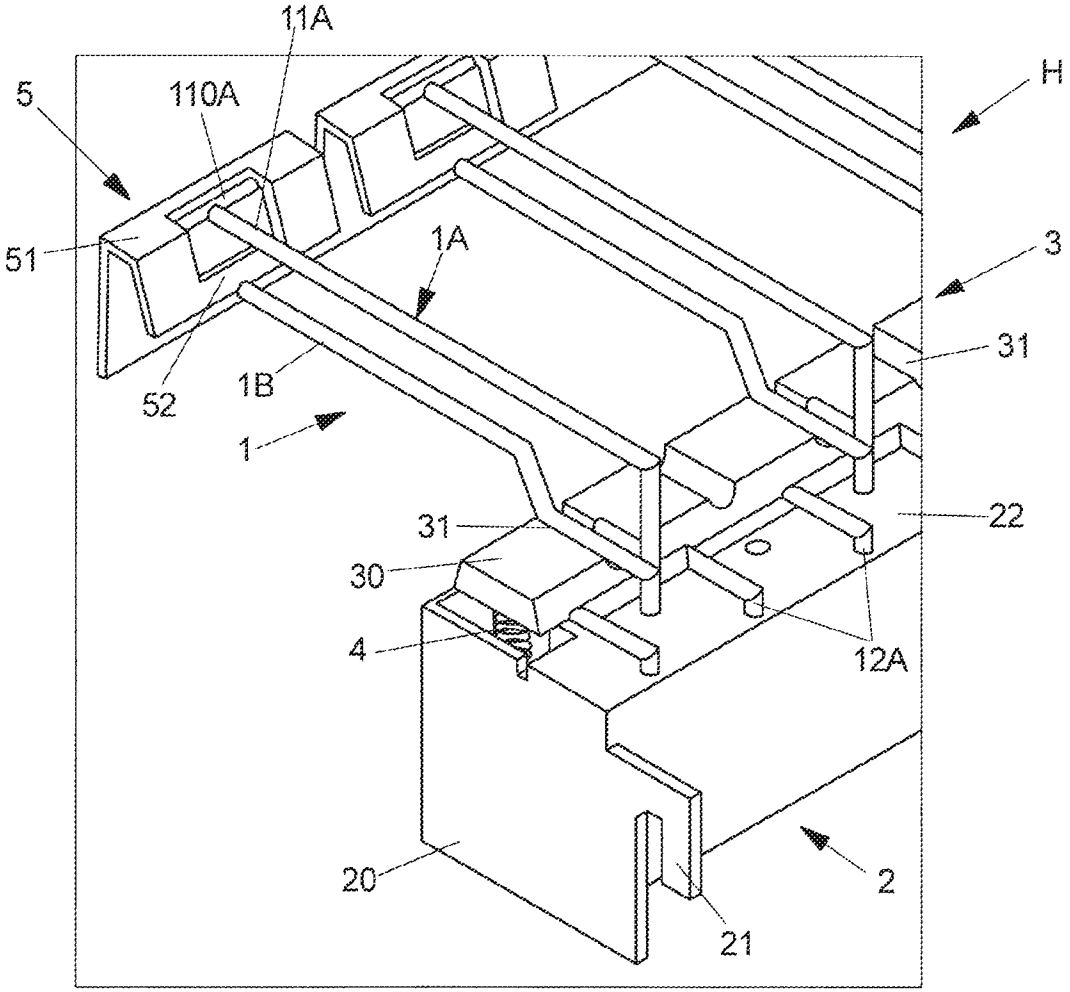
Figure 8B:
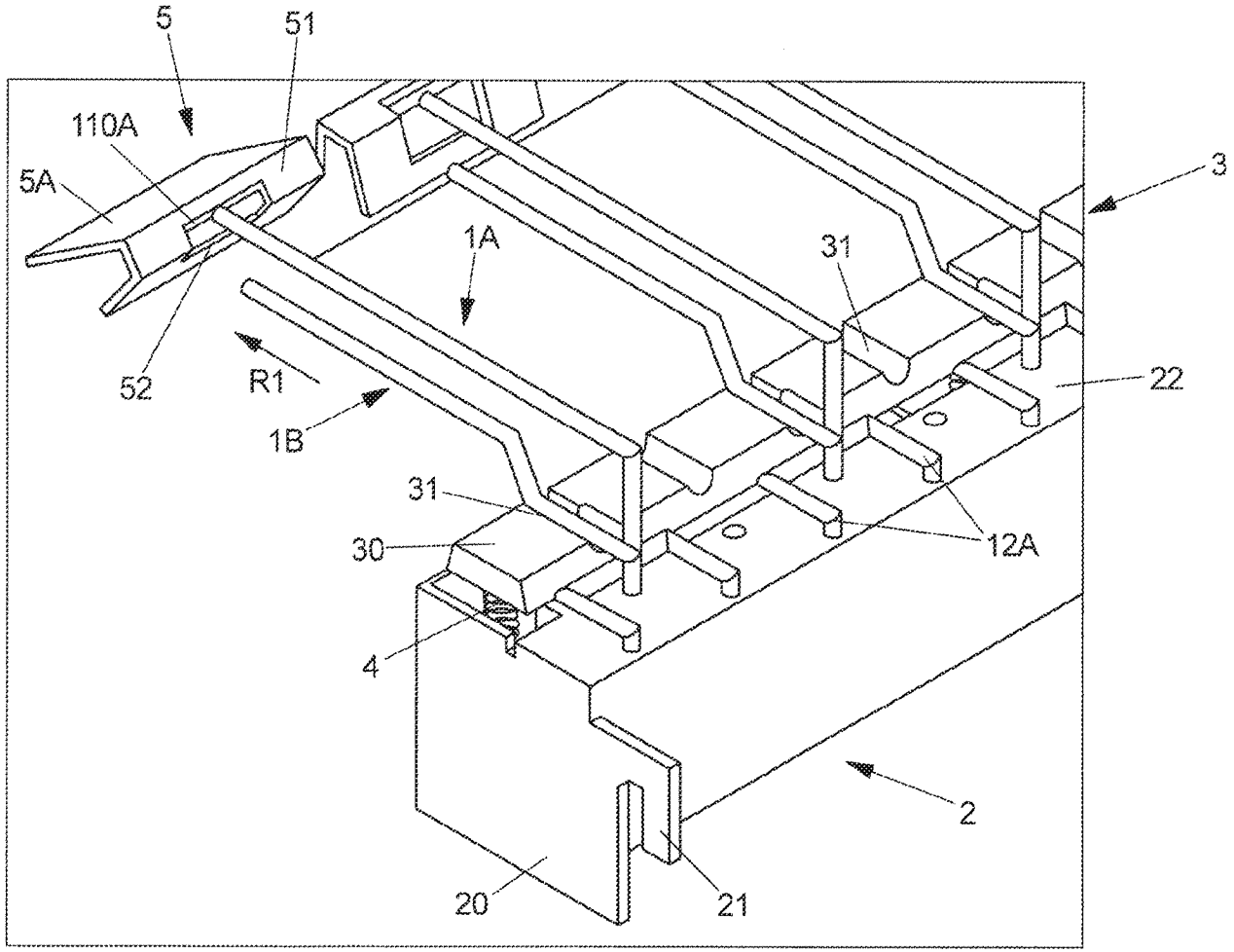
Figure 9A:
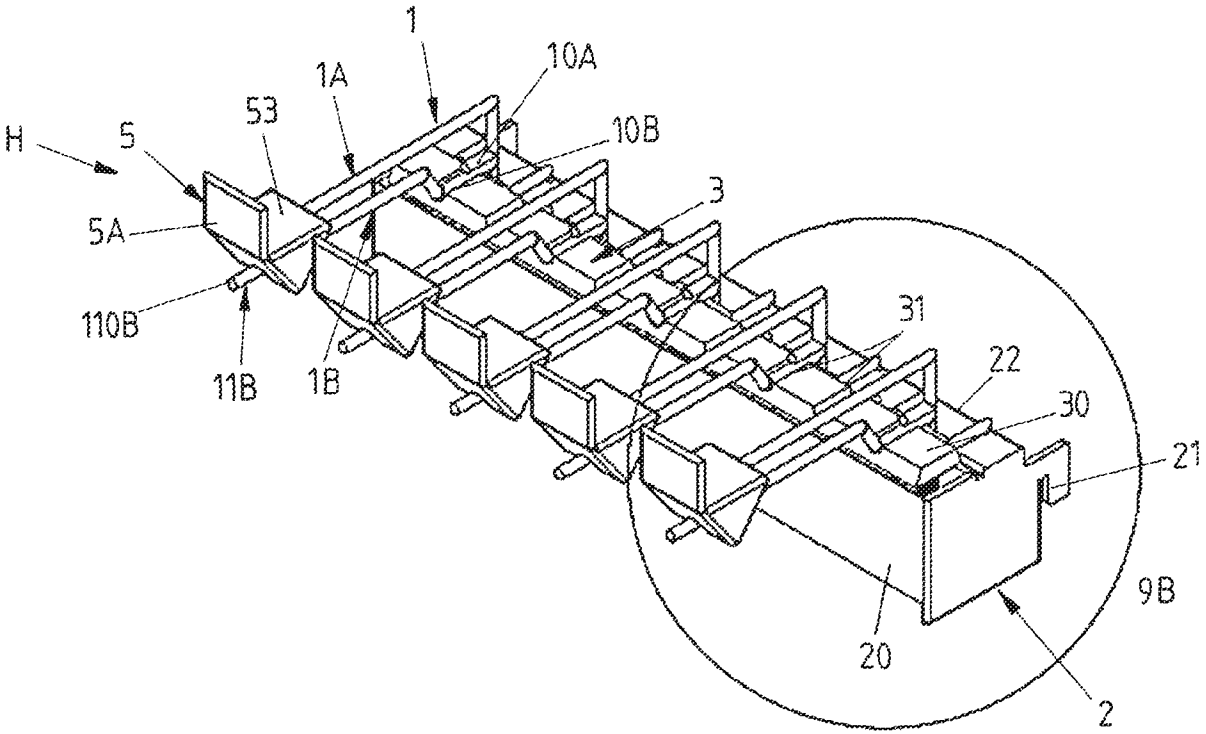
FIGS. 9A to 12 show a third embodiment of a holder assembly in which each elongated holding member is associated with an individual, immovable displacing element comprising a wedge-shaped displacing body. By the wedge-shaped displaying body an inclined contact surface is provided along which a good to be removed from the elongated holding member must slide. Thereby, a displacing force is applied to the at least one elongated holding member due to which the at least one elongated holding member is displaced downwards to its second position so that a good hanging on the least one elongated holding member may get past the wedge-shaped displacing body of the displacing element
Figure 9B:
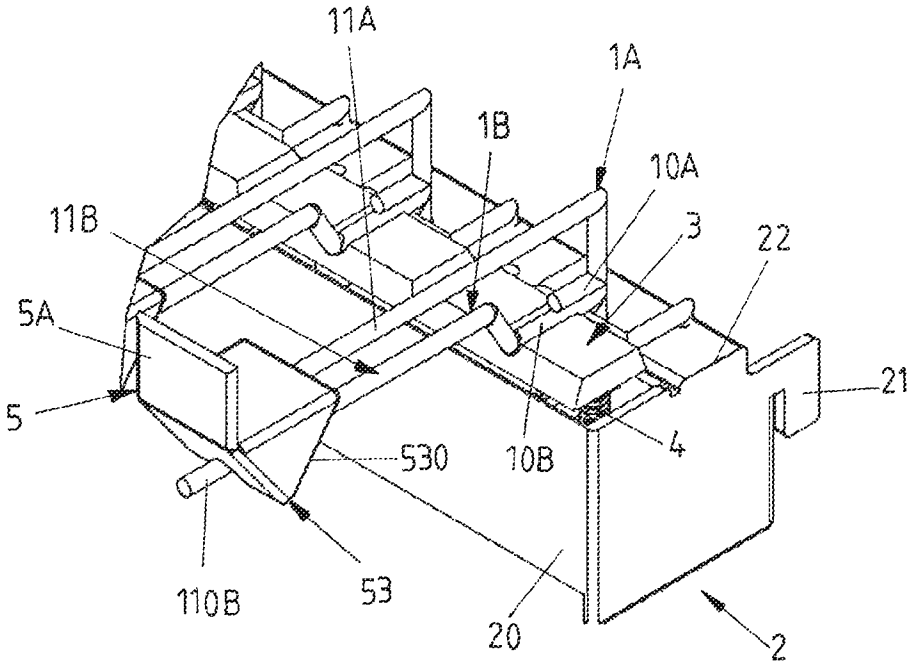
Figure 9C:
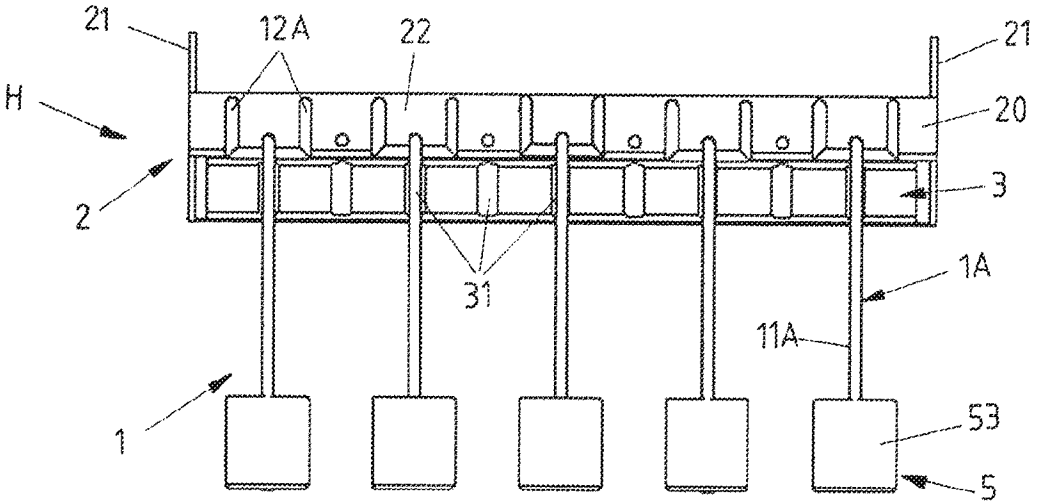
Figure 10:
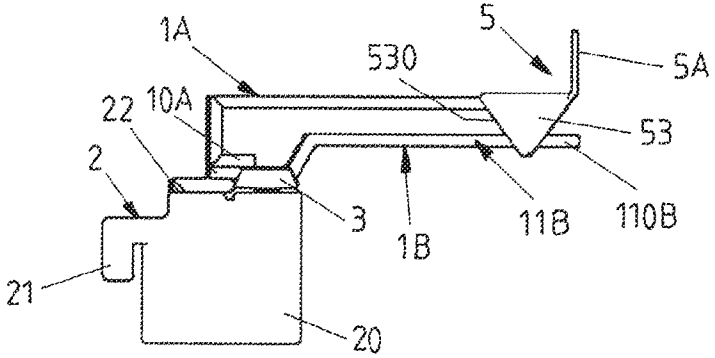
Figure 11:
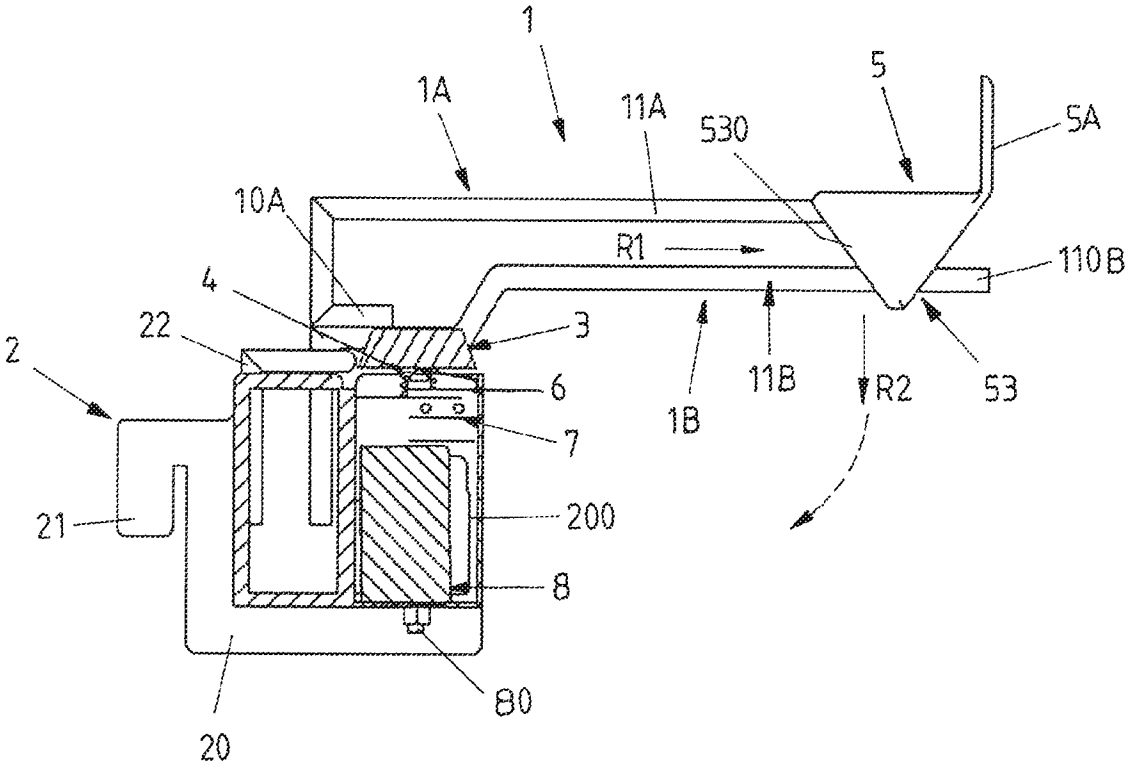
Figure 12:
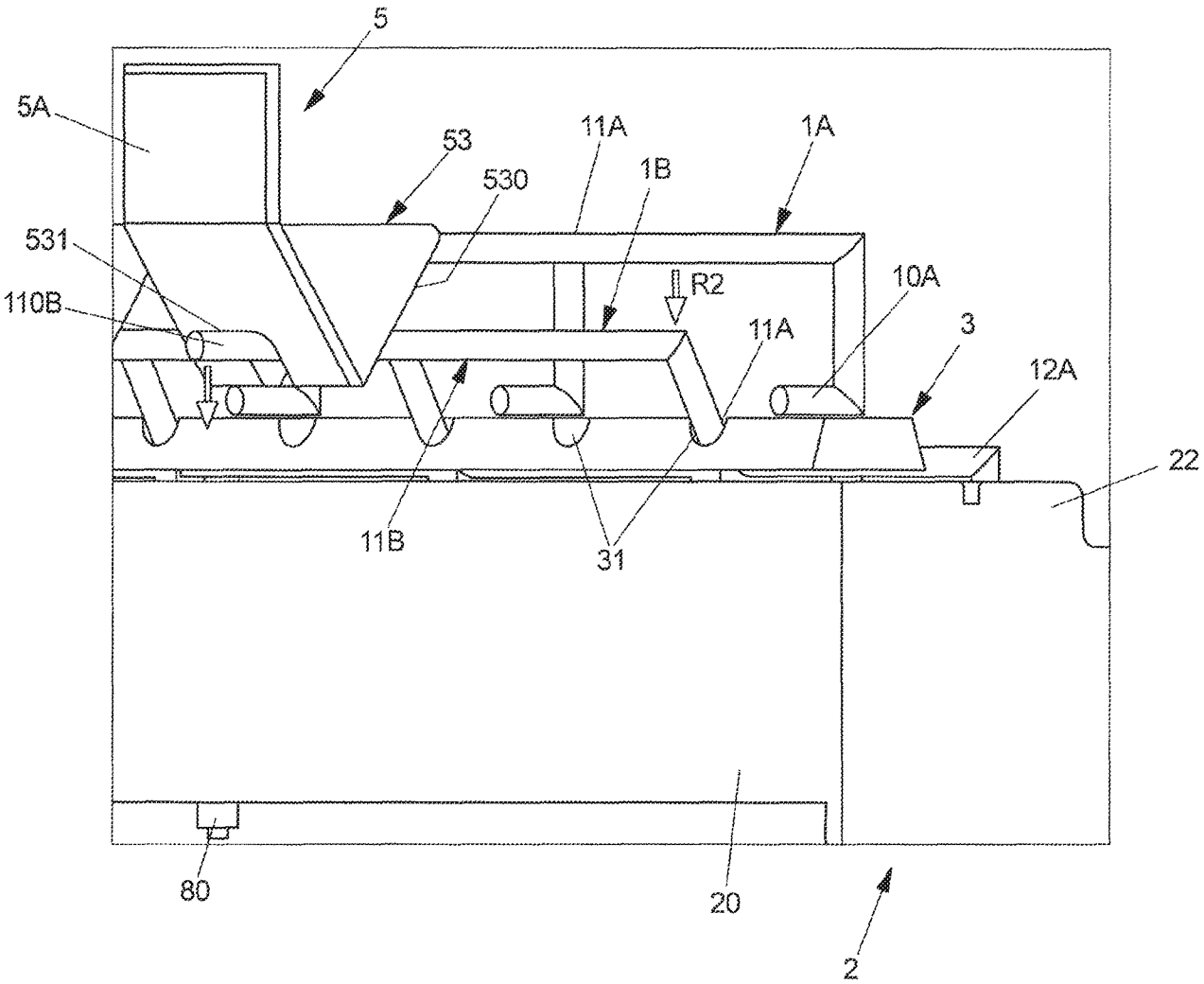

As shown in the cross-sectional view of FIG. 3 the trigger bar 3 with the bottom wire 1B in its second position actuates on an electronic detection element in the form of a micro-switch 6 accommodated in a housing interior 200 of the carrier housing 20. This micro-switch 6 is connected via connecting leads 72 to electronics 8 of the holder assembly H. By actuating on the micro-switch 6 a displacement of the bottom wire 1B downwards to its second position may be electronically detected. This electronic detection of the bottom wire 1B being displaced to the second position allows for a determination that at least one good is it to be removed or already has been removed from the bottom wire 1B. Since a removal of goods from the bottom wire 1B, in addition to sliding a good along the wire section 11B to the free end 110B along a direction of removal R1, requires pushing or pulling the bottom wire 1B and the trigger bar 3 downwards in a direction of displacement R2 perpendicular to the direction of removal R1 (see FIG. 3) thereby necessarily actuating the micro-switch 6, a removal of at least one good from the bottom wire 1B can be securely electronically detected.

The bottom wire 1B can also be rigidly fixed to the top wire 1A so that the bottom wire 1B as whole is not linearly displaceable downwards but may be swivelled about a swivel axis S provided at a connection between the bottom and top wires 1A, 1B. Here, the free end 110B may be swivelled downwards upon a removal of a good. The swivel movement of the bottom wire 1B also exerts a downward force on the trigger bar 3 in order to actuate the microswich 6. The rigid connection between the bottom wire 1B and the top wire 1A and thus the swivel axis S may be provided at the end of the bottom wire 1B near the carrier 2. For example, the rigid connection is provided by welding, in particular by spot-welding, the wire section 10B of the bottom wire 1B and the projection element 10A of the top wire in this case the element 10A of the top wire 1A thus not forming a stopper element but a connection element for the two wires 1A, 1B. Due to a flexibility inherent to the (single) bottom wire 1B the bottom wire 1B may in this case still be displaced to a second position relative to the top wire 1A about the swivel axis S defined at in the region the element 10A of the top wire 1A. Such a swivel movement about the swivel axis S also results in the trigger bar 3 being moved downwards and in thus actuating the micro-switch 6.

The electronics 8, which are fixed to the carrier housing 20 by a fastening structure 80, for example a bold or screw and a nut, are further configured to emit at least one signal based on one or more actuations of the microswitch 6. A signal may be an acoustic signal or an optical signal. At least one signal can for example be emitted every time the bottom wire 1B is displaced to its second position. For example, each time the bottom wire 1B is displaced into its second position an acoustic signal is emitted in order to indicate a (potential) removal of at least one good from the bottom wire 1B. Such an acoustic signal may be received by a receiver unit 9 shown in FIG. 1A. For detecting the acoustic signal the receiver unit 9 may comprise a microphone. The receiver unit 9 furthermore comprises an evaluation logic determining how many acoustic signals are received from the holder assembly H within a given period of time. The receiver unit 9 may thus determine a frequency of received acoustic signals and compare them against a signal threshold value. This signal threshold value corresponds to a threshold value for a removal frequency for the removal of the goods from the holder assembly H. In case a determined frequency of detected acoustic signals (and thus a removal frequency) exceeds the signal threshold value an illicit removal of goods by a shoplifter is considered to take place and an alarm signal is emitted by an alarm device D coupled to the receiver unit 9. In an alternative embodiment the signal received by the receiver is inaudible and transmitted wirelessly, i.e., as a radio wave signal. The electronics of the holder assembly H may thus be configured to transmit radio frequencies for informing the remote receiver unit 9 of a displacement of the bottom wire 1B to its second position. A wireless communication between the holder assembly H and the receiver unit 9 may be based on a wireless communication standard, like Bluetooth®, IEEE 802.11 or LTE®. The receiver unit 9 is configured to receive radio frequencies and emit an alarm signal in case the received signals over time exceed a threshold value as outlined above.

In the alternative or in addition to the alarming scenario described above the electronics 8 itself may include an evaluation logic for determining at least one of a frequency the bottom wire 1B is displaced to its second position and a time the bottom wire 1B stays in the displaced second position. In case the electronics 8 determine that a (frequency or time) threshold value is exceeded by the determined frequency or the measured time an acoustic alarm signal and/or a visual alarm signal is generated and emitted by the electronics 8 at the holder assembly H. For this purpose the electronics 8 may include at least one of a speaker and a lamp or diode, in particular an LED.

FIG. 4A to 8B show a second embodiment of a holder assembly H. In contrast to the first embodiment of FIGS. 1A to 3 the holder assembly H of FIGS. 4A to 8 comprises several holder devices 1 with displaceable tags 5 functioning in each case as a displacing element for displacing the respective bottom wire 1B to its second position upon removal of good from the bottom wire 1B.

The tag 5 of the embodiment of FIGS. 4A to 8B is hinged to transverse journal portions 110A provided at the end of the top wire 1A of a holder device 1. To these journal portions 110A a hinge portion 51 of the tag 5 is mounted so that the journal portions 110A define a pivot axis about which the tag 5 may be pivoted from a blocking position, as for example shown in FIGS. 7 and 8A, to a removal position, as for example shown in FIG. 8B. The hinge portion 51 of the tag 5 connects a front tag part with the front face 5A with a rear lobe portion 52 extending towards the bottom wire 1B.

In the first position of the bottom wire 1B the tag 5 with its lobe portion 52 is the blocking position in which the lobe portion 52 reaches into an adjustment path along which a good has to be slid along the bottom wire 1B towards the free end 110B of the bottom wire 1B. When a good, like a blister pack, hanging at the bottom wire 1B shall be removed from the bottom wire 1B and is thus pushed or pulled along the direction of removal R1 towards the free end 110B of the bottom wire 1B an upper part of the good (at which an opening is provided through which the bottom wire 1B extends) has to mandatorily contact the lobe portion 52 of the tag 5. Upon then sliding the good further towards the free and 110 B of the bottom wire 1B the good exerts a force on the lobe portion 52 toward the free end 110B. Due to this force the tag 5 is pivoted about the pivoting axis of the journal portions 110A of the bottom wire 1B. By pivoting the tag 5 the lobe portion 52 is (with its edge facing the wire section 11B of the bottom wire 1B) pushed against the bottom wire 1B and thus moved to a pushing position. In this pushing position the lobe portion 52 acts on the bottom wire 1B pushing it downwards to its second position upon further pivoting of the tag 5 in the clockwise direction along a swivel direction R3 (see FIG. 6). A force which is exerted on a good hanging at the bottom wire 1B in order to slide the good to the end 110B of the bottom wire 1B is thus partially converted by the hinged tag 5 with its lobe portion 52 into a displacing force exerted on the bottom wire 1B for displacing it from the first position to the second position. The displacement of the bottom wire 1B effected by the lobe portion 52 results in a displacement of the trigger bar 3 to which all the bottom wires 1B are mounted. Thereby the micro-switch 6 is actuated so that a removal of a good may be electronically detected and automatically evaluated as stated above.

When the good to be removed from the bottom wire 1B reaches the free end 110B of the bottom wire 1B the tag 5 is in a release position in which the lobe portion 52 no longer acts on the bottom wire 1B and thus no longer pushes the bottom wire 1B in its second position. Furthermore, the tag 5 also does no longer block a removal of the goods from the bottom wire 1B. By the springs 4 acting on the trigger bar 3 the bottom wire 1B is then pushed back upwards to its first position.

FIGS. 9A to 12 show a third embodiment of a holder assembly H in which each holder device 1 is provided with an immovable displacing element at the end of each top wire 1B. Each displacing element comprises a wedge-shaped displacing body 53 and a tag front part with the front face 5A attached or integrated to it. The wedge-shaped displacing body 53 is tapered towards the bottom wire 1B and comprises a wire slot 531 through which the free end 110B of the bottom wire 1B extends through the wedge-shaped displacing body 53 when the bottom wire 1B is in its first position.

The wedge-shaped displacing body 53 defines a rearward inclined contact surface 530 facing the carrier 2. Along this inclined contact service 530 a good hanging on the bottom wire 1B has to slide in order to get past the wedge-shaped displacing body 53. By sliding the good along the inclined contact surface 530 of the wedge-shaped displacing body 53 the good to be removed is forced downwards. The good thus will be automatically displaced with respect to the top wire 1A at which the wedge-shaped displacing body 53 is fixed to. The wedge-shaped displacing body 53 hence at least partially converts a force exerted on the good in order to move the good to the front of the bottom wire 1B (towards its free end 110B) to a force directed downwards. Thereby, for example, pulling a good towards the free end 110B of the bottom wire 1B necessarily results in the good to be forced downwards when the good comes into contact with the inclined contact surface 530 of the wedge-shaped displacing body 5.

Due to the connection between the good and the displaceable bottom wire 1B at which the good hangs this downward directed force results in a displacement of the bottom wire 1B with respect to the top wire 1A. The bottom wire 1B will thus necessarily be displaced into its second position in order to get the good past the wedge-shaped displacing body 53. A removal of one or more goods from the bottom wire 1B thus mandatorily results in a movement of the bottom wire 1B and the trigger bar 3 accompanied by an actuation of the micro-switch 6. Accordingly, the electronics 8 accommodated within the carrier housing 20 of the carrier 2 of the holder assembly H—as the case may be together with a receiver unit 9 and an alarm device D—allow for determining at least one of a removal frequency at which goods are removed from the bottom wire 1B and a time the bottom wire 1B is in its second position in which goods may get past the wedge-shaped displacing body 53 and thus may be removed from the bottom wire 1B as stated above.

Naturally, holder assembly H of FIGS. 1A to 3, 4A to 8B and 9 to 12 may also provided with less holder devices than shown. In particular a holder assembly H may be provided just comprising a single holder device 1. In this respect the carrier 2 and in particular its carrier housing 20 may be significantly smaller. The same applies to the trigger bar 3 which then may just comprise a single receptacle 31 to which the bottom wire 1B is fixed or at which the bottom wire 1B (configured to be swivelled about swivel axis S at its rear and) may act on the trigger bar 3.

Figure 13A:
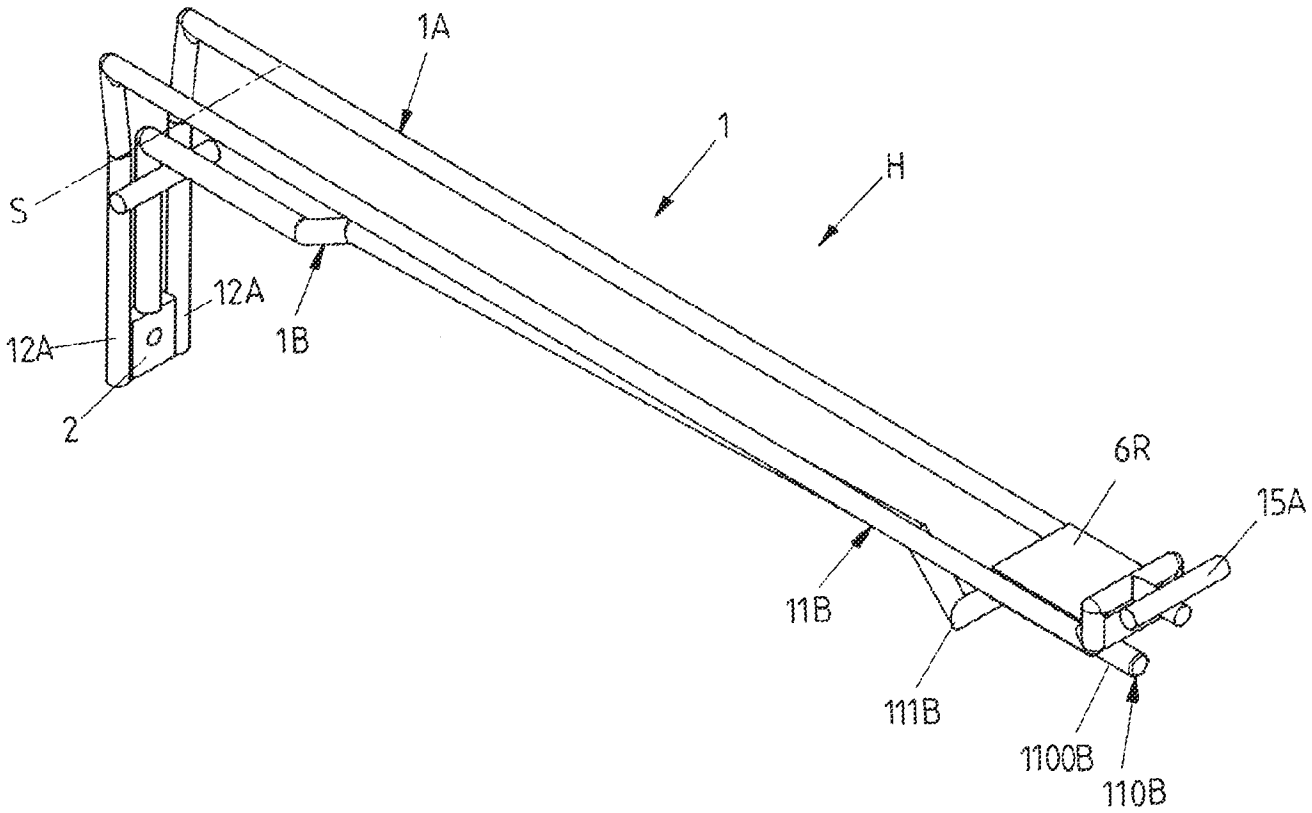
FIGS. 13A to 13C show a fourth embodiment of a holder assembly comprising a single holder device and a reed switch (or reed relay) in order to detect a removal of a good from an elongated holding member of the holder device.
Figure 13B:
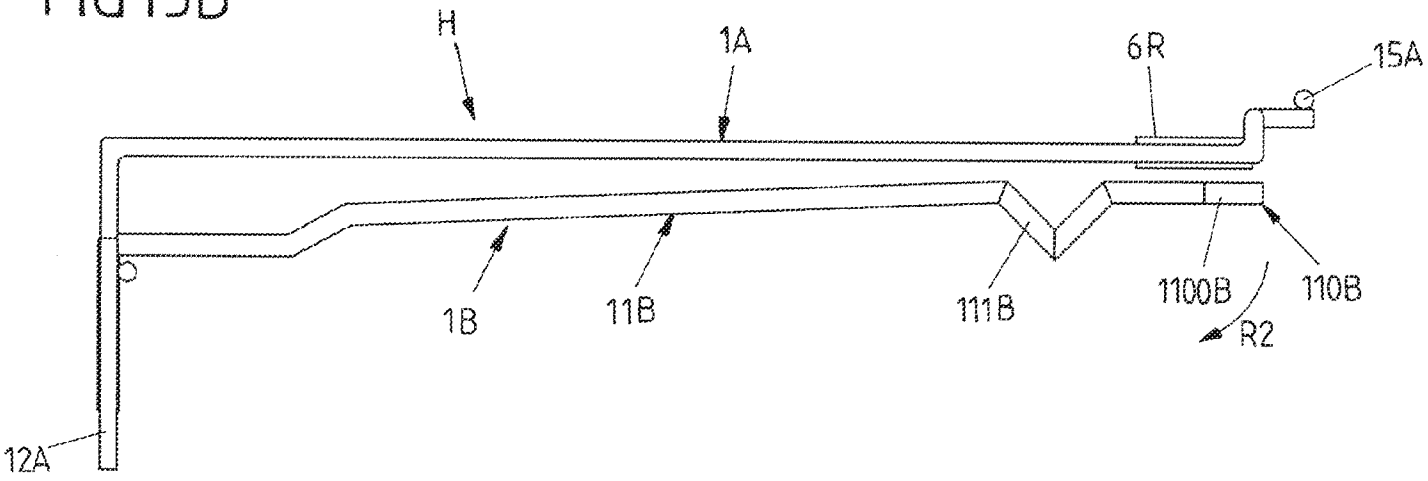
Figure 13C:
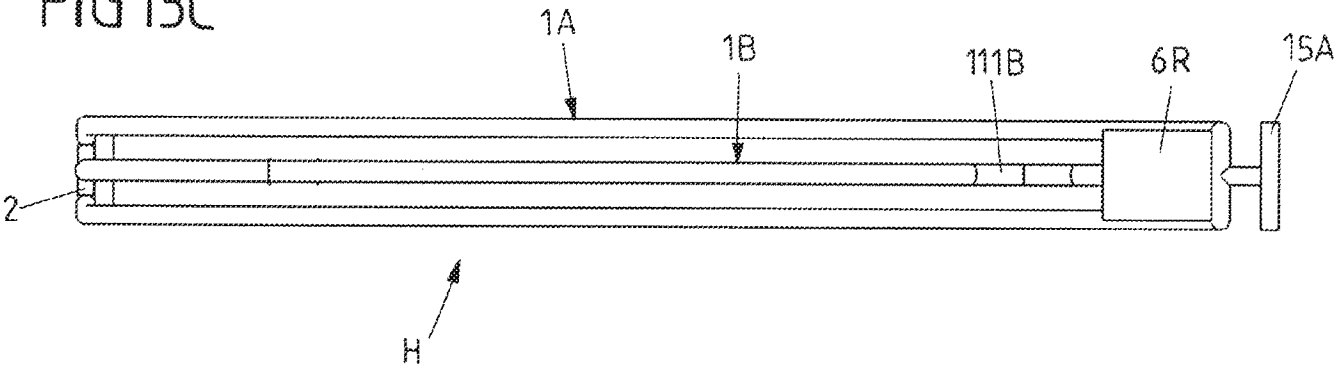

FIGS. 13A, 13B and 13C show an embodiment of a holder assembly H which comprises a single holder device 1. The top wire 1A of the holder device 1 includes two parallel wire sections and the single bottom wire 1B extends beneath the top wire 1A in the middle of those two wire sections. Both the top wire 1A and the bottom wire 1B are fixed at their rear ends to a carrier 2.

The bottom wire 1B of the holder assembly H of FIGS. 13A to 13C is again displaceable with respect to the top wire 1A so that it may be displaced from a first position shown in FIGS. 13A to 13C to a second position upon a removal of goods from the bottom wire 1B. In the embodiment shown in FIGS. 13A to 13C the free end 110B of the bottom wire 1B may be swivelled about the swivel axis S at the rear end of the bottom wire 1B downwards in order to allow the removal of goods from the bottom wire 1B at the free end 110B.

In order to ensure that just one good at the time is removed from the bottom wire 1B its wire section 11B near free end 110B forms are recessed portion 111B. This recessed portion 111B is V-shaped and hinders that more than one good may be moved past the recessed portion 111B to the free end 110B.

For electronically detecting displacement of the bottom wire 1B to its second position the holder assembly H of FIGS. 13A to 13C comprises an electronic detection element including a magnet 1100B and a reed switch 6R. The magnet 1100B is provided at the free end 110B of the bottom wire 1B, whereas the reed switch 6R is mounted to the top wire 1A opposite the free end 110B of the bottom wire 1B. Due to a change of position of the free end 110B and thus the magnet 1100B provided at the free end 110B a magnetic field applied to the reed switch 6R changes resulting in a generation of an electrical signal. For example, contacts of the reed switch 6 are open when the bottom wire 1B is in its first position and thus a magnetic field of the magnet 1100B of the bottom wire 1B is present. When the bottom wire 1B with its free end 110B is swivelled downwards and thus displaced into its second position for a removal of a good from the bottom wire 1B the distance between the magnet 1100B to the reed switch 6R increases. When the magnetic field provided by the magnet 1100B is thus the no longer present near the reed switch 6R the contacts of the reed switch 6 return to a normal closed position thereby generating an electric signal. This electric signal is thus indicative for the displacement of the bottom wire 1B to its second position. After the good has been removed from the bottom wire 1B the bottom wire 1B, due to its flexibility, returns to its first position in which the magnet 1100B at the free end 110B is closer to the reed switch 6R of the top wire 18. The contacts of the read switch 6 are thus forced again to an open position.

For pivotably fixing a tag to the holder device 1 of FIGS. 13A to 13 C the front end of the top wire 1A comprises tag fastening portion 15A. The tag fastening portion 15A in the exemplary embodiment of FIGS. 13A to 13C therefore comprises a transverse journal to which a tag may be clipped.

It is clear that the electronic detection of a displacement of the bottom wire 1B to its second position as outlined above for the holder assembly H of FIGS. 13A to 13C may also be implemented by a holder assembly H being configured such that the contacts of the reed switch 6R are normally open and held closed by the magnet 1100B in the first position of the bottom wire 1B. In this case the contacts return to a normal open position upon displacement of the bottom wire 1B with its magnet 1100B to the second position. The reed switch 6R may also be provided at the bottom wire 1B and the magnet 1100B may be provided at the top wire 1A without departing from the present disclosure. Furthermore, a holder device 1 of FIGS. 13A to 13C including a reed switch 6R may also be provided at a holder assembly H of FIGS. 1A to 3, 4A to 8B and 9 to 12. Accordingly, a holder assembly may be provided with several holder devices 1 as shown in FIGS. 13A to 13C which are then mounted to a single carrier.

The foregoing description of the embodiments has been provided for purposes of illustration and description. It is not intended to limit the disclosure. Individual elements or features of a particular embodiment are generally not limited to that particular embodiment, but, where applicable, are interchangeable and can be implemented in another embodiment, even if not specifically shown or described. The same elements may also be varied in one or more ways. Such variations are not to be regarded as a departure from the disclosure, and all such modifications are intended to be included within the scope of the disclosure.

What is claimed is:

1. A holder assembly for hanging goods to be displayed at a point of sale, comprising:

at least one elongated holding member at which goods are to be hanged and to be arranged in a row of goods one behind the other so that the hanging goods may be slid along the at least one elongated holding member to a removal position at an end of the at least one elongated holding member where a good may be removed from the at least one elongated holding member; and a carrier to which the at least one elongated holding member is mounted and at which an electronic detection element is provided, wherein the at least one elongated holding member is displaceable between a first position and a second position with a motion component in the vertical direction, wherein the at least one elongated holding member is configured to be displaced from the first position to the second position in order to allow a removal of at least one foremost good of a row of hanging goods arranged at the at least one elongated holding member from the at least one elongated holding member so that the at least one elongated holding member is displaced from the first position to the second position every time one good is removed from the at least one elongated holding member, and wherein the electronic detection element is configured to detect a displacement of the at least one elongated holding member from the first position to the second position for emitting at least one signal every time one good is removed from the at least one elongated holding member.

2. The holder assembly of claim 1, wherein the at least one elongated holding member is configured to be swivelled about a swivel axis running perpendicular to a direction along which goods are slidable at the at least one elongated holding member.

3. The holder assembly of claim 1, wherein the at least one elongated holding member is configured to be manually pressed or pulled from the first position to the second position by a user before at least one good may be removed from the at least one elongated holding member.

4. The holder assembly of claim 1, wherein the at least one elongated holding member is configured to be displaced from the first position to the second position upon sliding at least one good to the end of the at least one elongated holding member.

5. The holder assembly of claim 4, wherein the holder assembly comprises a displacing element associated with the at least one elongated holding member, wherein a force, which is exerted on a good hanging at the at least one elongated holding member in order to slide the good to the end of the at least one elongated holding member, is partially converted by the displacing element into a displacing force exerted on the at least one elongated holding member for displacing the at least one elongated holding member from the first position to the second position.

6. The holder assembly of claim 5, wherein the displacing element comprises a tag configured to display information on the goods to be arranged at the at least one elongated holding member.

7. The holder assembly of claim 5, wherein the displacing element is configured for pushing the at least one elongated holding member from the first position to the second position.

8. The holder assembly of claim 5, wherein the displacing element is configured to be displaced in order to partially convert the force exerted on the good into the displacing force.

9. The holder assembly of claim 8, wherein the displacing element is mounted pivotably at a holder part of the holder assembly, which holder part is spaced apart from the at least one elongated holding member and past which holder part a good is to be moved when the good is slid towards the end of the at least one elongated holding member.

10. The holder assembly of claim 5, wherein the displacing element includes a wedge-shaped body.

11. The holder assembly of claim 1, wherein the at least one elongated holding member is biased towards the first position by at least one spring element.

12. The holder assembly of claim 1, wherein the at least one elongated holding member is fixed to a trigger element at the carrier, the trigger element being displaceable relative to the electronic detection element.

13. The holder assembly of claim 1, wherein the electronic detection element comprises at least one of a microswitch or a reed switch.

14. The holder assembly of claim 1, wherein the holding assembly comprises electronics for determining at least one of a removal frequency at which goods are removed from the at least one elongated holding member and a time the at least one elongated holding member is in the second position.

15. The holder assembly of claim 1, wherein the holding assembly comprises electronics for emitting at least one of an acoustic signal and an optical signal for indicating a removal of at least one good from the at least one elongated holding member based on a displacement of the at least one elongated holding member from the first position to the second position.

16. The holder assembly of claim 1, wherein the holder assembly comprises at least two elongated holding members.

17. The holder assembly of claim 16, wherein the at least two elongated holding members are fixed to one trigger element at the carrier, the trigger element being displaceable relative to the electronic detection element.

18. A holder assembly for hanging goods to be displayed at a point of sale, comprising:

at least one elongated holding member at which goods are to be hanged and to be arranged in a row of goods one behind the other so that the hanging goods may be slid along the at least one elongated holding member to a removal position at an end of the at least one elongated holding member where a good may be removed from the at least one elongated holding member; and a carrier to which the at least one elongated holding member is mounted and at which an electronic detection element is provided, wherein the at least one elongated holding member is displaceable between a first position and a second position, wherein the at least one elongated holding member is configured to be displaced from the first position to the second position upon sliding at least one good to the end of the at least one elongated holding member in order to allow a removal of at least one foremost good of a row of hanging goods arranged at the at least one elongated holding member from the at least one elongated holding member, wherein the electronic detection element is configured to detect a displacement of the at least one elongated holding member from the first position to the second position for emitting at least one signal, and wherein the holder assembly comprises a displacing element associated with the at least one elongated holding member, wherein a force, which is exerted on a good hanging at the at least one elongated holding member in order to slide the good to the end of the at least one elongated holding member, is partially converted by the displacing element into a displacing force exerted on the at least one elongated holding member for displacing the at least one elongated holding member from the first position to the second position, wherein the displacing element is configured to be displaced in order to partially convert the force exerted on the good into the displacing force, wherein the displacing element is mounted pivotably at a holder part of the holder assembly, which holder part is spaced apart from the at least one elongated holding member and past which holder part a good is to be moved when the good is slid towards the end of the at least one elongated holding member, and wherein the displacing element comprises a lobe portion extending towards the at least one elongated holding member and extending into an adjustment path along which a good is to be moved towards the end of the at least one elongated holding member so that the good has to contact the lobe portion and thus pivot the displacing element before the good can be removed from the at least one elongated holding member, the lobe portion thereby and upon pivoting of the displacing element pushing the at least one elongated holding member from the first position to the second position.

19. The holder assembly of claim 18, wherein the lobe portion is displaceable upon pivoting of the displacing element from (1) a blocking position, in which the lobe portion reaches into the adjustment path of a good to be moved towards the end of the at least one elongated holding member, via (2) a pushing position, in which the lobe portion pushes the at least one elongated holding member to the second position by increasing a distance of the at least one elongated holding member to the holding part at which the displacing element is pivotably mounted, to (3) a removal position, in which the good may be removed from the at least one elongated holding member and the lobe portion no longer pushes the at least one elongated holding member to the second position.

20. A holder assembly for hanging goods to be displayed at a point of sale, comprising:

at least one elongated holding member at which goods are to be hanged and to be arranged in a row of goods one behind the other so that the hanging goods may be slid along the at least one elongated holding member to a removal position at an end of the at least one elongated holding member where a good may be removed from the at least one elongated holding member; and a carrier to which the at least one elongated holding member is mounted and at which an electronic detection element is provided, wherein the at least one elongated holding member is displaceable between a first position and a second position, wherein the at least one elongated holding member is configured to be displaced from the first position to the second position upon sliding at least one good to the end of the at least one elongated holding member in order to allow a removal of at least one foremost good of a row of hanging goods arranged at the at least one elongated holding member from the at least one elongated holding member, wherein the electronic detection element is configured to detect a displacement of the at least one elongated holding member from the first position to the second position for emitting at least one signal, wherein the holder assembly comprises a displacing element associated with the at least one elongated holding member, wherein a force, which is exerted on a good hanging at the at least one elongated holding member in order to slide the good to the end of the at least one elongated holding member, is partially converted by the displacing element into a displacing force exerted on the at least one elongated holding member for displacing the at least one elongated holding member from the first position to the second position, and, wherein the displacing element is immovable and comprises an inclined contact surface along which a good hanging on the at least one elongated holding member and moved towards the end of the at least one elongated holding member for removal has to slide, thereby pushing the at least one elongated holding member to its second position in order to get the good past the displacing element.

* * * * *